US010702920B2

(12) United States Patent
Haidar

(10) Patent No.: US 10,702,920 B2
(45) Date of Patent: Jul. 7, 2020

(54) COATING OF PARTICULATE SUBSTRATES

(71) Applicant: OTHRYS TECHNOLOGIES PTY LTD, Caringbah (AU)

(72) Inventor: Jawad Haidar, Bexley (AU)

(73) Assignee: Othrys Technologies PTY LTD, Caringbah (AU)

( * ) Notice: Subject to any disclaimer, the term of this patent is extended or adjusted under 35 U.S.C. 154(b) by 0 days.

(21) Appl. No.: 16/311,622

(22) PCT Filed: Jun. 20, 2017

(86) PCT No.: PCT/AU2017/050618
§ 371 (c)(1),
(2) Date: Dec. 19, 2018

(87) PCT Pub. No.: WO2017/219075
PCT Pub. Date: Dec. 28, 2017

(65) Prior Publication Data

US 2019/0201973 A1 Jul. 4, 2019

(30) Foreign Application Priority Data

Jun. 20, 2016 (AU) ..... 2016902408

(51) Int. Cl.
*B22F 1/02* (2006.01)
*C23C 24/08* (2006.01)
*C23C 18/16* (2006.01)

(52) U.S. Cl.
CPC ..... *B22F 1/025* (2013.01); *C23C 18/1601* (2013.01); *C23C 24/08* (2013.01);
(Continued)

(58) Field of Classification Search
None
See application file for complete search history.

(56) References Cited

U.S. PATENT DOCUMENTS 3,172,865 A 3/1965 Fennell
3,451,768 A 6/1969 Luciani et al.
(Continued)

FOREIGN PATENT DOCUMENTS

EP 2 130 627 A1 12/2009
JP S 54-145089 A 11/1979
(Continued)

OTHER PUBLICATIONS

Australian Patent Office, International Preliminary Report on Patentability in PCT Application No. PCT/AU2017/050618, dated Oct. 15, 2018.
(Continued)

*Primary Examiner* — George Wyszomierski
(74) *Attorney, Agent, or Firm* — Cahn & Samuels, LLP

(57) ABSTRACT

The present invention relates to a method for coating large area solid substrates with titanium by reacting the substrate surface with a mixture comprising titanium halide or sub-halide powders in the presence of a reducing agent. The method is suited for coating large area substrates such as flakes, powder, beads and fibres with elemental Ti-base metals or alloys of Ti with coating additives based on any number of non inert elements from the periodic table.

19 Claims, 4 Drawing Sheets

(52) U.S. Cl.
CPC ..... *C23C 24/082* (2013.01); *C23C 24/087* (2013.01); *B22F 2998/10* (2013.01); *B22F 2999/00* (2013.01); *C23C 18/16* (2013.01)

(56) References Cited

U.S. PATENT DOCUMENTS

| | | | | |
|---|---|---|---|---|
| 3,530,107 | A | 9/1970 | Yoshioka et al. | |
| 3,998,911 | A | 12/1976 | Strametz et al. | |
| 4,079,175 | A | 3/1978 | Tokunaga et al. | |
| 4,239,819 | A | 12/1980 | Holzl | |
| 4,399,167 | A | 8/1983 | Pipkin | |
| 4,696,834 | A | 9/1987 | Varaprath | |
| 4,803,127 | A | 2/1989 | Hakim | |
| 5,171,734 | A | 12/1992 | Sanjurjo et al. | |
| 5,227,195 | A | 7/1993 | Sanjurjo | |
| 5,855,678 | A | 1/1999 | Sanjurjo et al. | |
| 6,169,031 | B1 | 1/2001 | Lee | |
| 6,241,858 | B1 | 6/2001 | Phillips et al. | |
| 6,676,741 | B2 | 1/2004 | Phillips et al. | |
| 8,834,601 | B2 | 9/2014 | Haidar | |
| 10,035,078 | B2 | 7/2018 | Chryss et al. | |
| 2002/0187082 | A1* | 12/2002 | Wu | B82Y 30/00 422/139 |
| 2006/0019146 | A1* | 1/2006 | Yoshitake | B01J 23/42 429/482 |
| 2006/0191372 | A1* | 8/2006 | Haidar | B01J 19/088 75/10.21 |
| 2009/0183651 | A1* | 7/2009 | Hung | B82Y 30/00 106/436 |
| 2010/0047579 | A1* | 2/2010 | Tokoro | B22F 1/02 428/403 |
| 2011/0052803 | A1 | 3/2011 | Bao et al. | |
| 2013/0019717 | A1* | 1/2013 | Haidar | C22C 14/00 75/613 |
| 2017/0222223 | A1* | 8/2017 | Hong | H01M 4/525 |

FOREIGN PATENT DOCUMENTS

| | | | |
|---|---|---|---|
| JP | S 62-249415 | A | 10/1987 |
| JP | H 07-297136 | A | 11/1995 |
| JP | 3358810 | B2 | 10/2002 |
| JP | 2003-055649 | A | 2/2003 |
| JP | 2008-212918 | A | 9/2008 |
| JP | 2013-529252 | A | 7/2013 |
| JP | 2013-173649 | A | 9/2013 |
| JP | 2015-160991 | A | 9/2015 |
| JP | 2016026265 | A | 2/2016 |
| WO | 2005002766 | A1 | 1/2005 |
| WO | 2007109847 | A1 | 10/2007 |
| WO | 2009085342 | A1 | 7/2009 |

OTHER PUBLICATIONS

European Patent Office, extended European search report in EP App. No. 17814320.2, dated Nov. 21, 2019, pp. 1-7.
Eurasian Patent Office, Notification of the necesary to present additional materials in EA App. No. 201892749/28, dated Dec. 19, 2019, pp. 1-3.
Japan Patent Office, Notification of Reasons for Refusal in JP App. No. 2019-518339, dated Nov. 5, 2019, pp. 1-7.
Industrial Property Cooperation Center, Japan Patent Office, Search Report by Registered Search Organization in JP App. No. 2019-518339, dated Sep. 12, 2019, pp. 1-20.
European Patent Office, English abstract for JP2016026265A, printed on Feb. 25, 2020, p. 1.
European Patent Office, English abstract for JP2013173649A, printed on Feb. 25, 2020, p. 1.
European Patent Office, English abstract for JPH07297136A, printed on Feb. 25, 2020, p. 1.
European Patent Office, English abstract for JP2015160991A, printed on Feb. 25, 2020, p. 1.
European Patent Office, English abstract for JP2008212918A, printed on Feb. 25, 2020, p. 1.
European Patent Office, English abstract for JP2003055649A, printed on Feb. 25, 2020, p. 1.

* cited by examiner

COATING OF PARTICULATE SUBSTRATES

FIELD OF THE INVENTION

The present invention relates to a method and an apparatus for coating solid objects with metallic alloys and compounds based on titanium.

BACKGROUND OF THE INVENTION

Titanium coating on large area substrates such as powders or flakes can have applications as pigments in auto paint, corrosion protection, cosmetics, architectural and decorative use, and as functional materials and catalysts. Processes to form titanium-based coatings include physical deposition (PD), chemical vapour deposition (CVD), and powder immersion reaction assisted coating (PIRAC).

PD often requires low pressure operation and involves use of metallic precursors. PD is based on evaporating a target and transporting the vapour onto the surface of the substrate. PD is generally slow and expensive, and can be difficult to implement for coating powdery substrates. Examples of PD technologies can be found in U.S. Pat. Nos. 6,241,858 and 6,676,741 describing processes for coating powder samples to produce metallic pigments.

CVD is a heterogeneous process, which involves reacting reducible precursors with a reactive gas on the surface of the substrate, leading to deposition of a thin coating. Most CVD processes for deposition of Ti-based films start from titanium tetrachloride and proceed to producing subchlorides, and then reacting or dissociating the subchlorides to form coatings. Conventional CVD processes/reactors are usually not amenable to coating powders. Examples of CVD based processes for deposition of Ti can be found in U.S. Pat. Nos. 4,803,127 and 6,169,031, both pertaining to reduction of $TiCl_4$ to subchlorides and then dissociation of the resulting subchlorides over a single non-powdery substrate.

Variants of CVD systems include fluidised beds, which have been used for production of coatings based on metal carbides and metal nitrides for applications in hard coating and corrosion protection; U.S. Pat. Nos. 5,171,734, 5,227,195 and 5,855,678 (Sanjurjo et al.) disclose a fluidised bed process based on reacting gaseous $TiCl_4$ with Ti, Cr, Zr, Nb, Mo, Hf, Ta, Mo, Si and Al in a fluidised bed at temperatures between 200° C. and 1000° C. to produce titanium subchlorides followed by further gas reduction at the substrate surface to produce coatings based on carbides, nitrides and oxides. Possible downsides to this approach include the difficult nature of gas phase reduction, the high cost of reducing metals such as Ti, Cr, Zr, Nb, Mo, Hf, Ta, Mo, and Si, and for Al reduction, the high temperature range used.

PIRAC has been used for coating ceramic substrates, where a substrate is immersed in a metallic powder and heated at temperatures above 800° C. to cause the substrate surface to react with the powder and form a metallic skin. For example, $Si_3N_4$ flakes are immersed in a titanium powder and heated at temperatures above 850° C. to form a coating of $Ti_5Si_3$ and titanium nitride. PIRAC is mostly limited to high temperature substrate materials; substrates such as borosilicate glass flakes and soda-glass which are unstable at temperatures above 700° C. and are unsuitable.

It is advantageous to develop a low-cost process for depositing Ti-based coating on large area substrates such as powders and flakes. Such a process would be particularly desirable if it was capable of producing a range of Ti-based coatings on common powdery substrates without the environmental and cost disadvantages of existing technologies.

SUMMARY OF THE INVENTION

Herein:

- the term titanium-based (or Ti-based) means one or more of pure titanium, titanium-based alloys, titanium-based intermetallic compounds, titanium oxides, titanium carbides, titanium nitrides, titanium borides, titanium silicides and/or any titanium alloy or compound containing titanium at levels of at least 10 weight % in the coating material,
- the term "titanium subhalide" or "titanium subchloride" refer respectively to a titanium halide or chloride having less than 4 halogen atoms per titanium atom, for example $TiCl_3$, $TiCl_2$ or a mixture thereof.
- the term "large area substrate" or "particulate substrate" is used to describe materials in the form of particles, powder, flakes, beads, fibres or similar, or generally a large number of small objects with a large surface area (e.g. washers, screws, fasteners). The substrate preferably has an average size in at least one dimension of less than 10 mm, more preferably less than 5 mm, 1 mm or 500 microns. The substrate materials can be a dielectric or a conductor, and can be a pure element, an alloy, or a compound,
- the term nanopowder or nanopowders refers to powders based on metallic Ti based species (e.g. Ti and Ti—Al) and $TiCl_x$, wherein the powder has a component with an average grain size less than 1 micron and preferably less than 100 nanometers and more preferably less than 1 nanometer. Preferably the said component is more than 20% and more preferably more than 40%, 60% or 80%, of the powder.
- the term "uncoated powder" or "uncoated nanopowder" refers to a Ti-based powder/nanopowder where the surface of the powder grains is substantially unoxidised.

Unless otherwise specified, the term reducing agent and "$R_a$" refer to Na, K, or Al in a powder form or $H_2$ in a gaseous form.

One form of the present invention provides a method for coating large area substrates with a titanium-based coating, wherein a substrate is reacted with an uncoated Ti-based powder or nanopowder formed by reaction of one or more solid titanium halides, such as subchloride, with a reducing agent at temperatures between 25° C. and 850° C., resulting in formation of coating on the substrate.

One method for forming Ti-based coatings on a particulate substrate, includes:

a. Mixing the particulate substrate with an uncoated Ti-based powder formed by contacting a powder containing a solid powder comprising titanium halide or sub-halide with a reducing agent; and
b. Heating the particulate substrate in contact with said uncoated Ti-based powder to a temperature less than 850° C. to produce a coating on said particulate substrate.

Optionally, the reducing agent may contain one or more of Na, K, or Al, or H2, and/or the titanium halide or sub-halide may comprise a titanium subchloride.

Preferred forms of the inventive method aim to improve upon the powder immersion reaction assisted coating (PIRAC) technique due to a number of factors, including the enhanced reactivity of uncoated powders, and the catalytic effects of the substrate on reactions between titanium subchlorides and Na, K and Al.

The use of uncoated powders is believed to have advantages over prior relevant art in that the oxygen free surface of the nano-particulates enables significant reduction in the temperature threshold for triggering reactions between the substrate surface and the powder. This together with the additional effects due to the catalytic action of the substrate on reactions involving titanium subchlorides is believed to allow for considerable reduction in the temperature required to form coatings; therefore, the new method is understood to expand the range of substrate materials and/or coatings that can be produced.

In a first aspect, there is provided a method for coating large area substrates with Ti-based materials, wherein a particulate substrate is immersed in a powder comprising a metallic Ti-based powder, titanium subchlorides, optionally coating additives, and a reducing agent, and then the mixture is heated at temperatures below 850° C. and preferably below 750° C. and still more preferably below 650° C. to metallise the substrate surface or form a metallic Ti-based coating on the substrate surface.

In example forms, the reducing agent can include Na, K, and/or Al, and can be in the form of an alloy, compound or a pure element in a powder form. In some other forms, the reducing agent can be part of the substrate composition.

The term "coating additives" refers to materials in a fine particulate form, based on non-inert elements from the periodic table. Hereinafter, the term "$M_z$" is used to refer to precursors for the coating additives.

The coating may include a titanium alloy or a titanium compound and can include materials from the substrate in addition to any number of coating additives based on any non-inert element chosen from the periodic table. The method can be carried out in a batch mode, in a semi-continuous mode or in a continuous mode.

In a second aspect, there is provided a method for metallising the surface of particulate substrates, such as a powder, wherein a reactive substrate is reacted with a mixture comprising titanium subchlorides at temperatures below 850° C. and preferably below 750° C. and still more preferably below 650° C. Resulting modifications to the substrate can include formation of a skin layer on the substrate surface with a chemical composition comprising titanium, formation of a coating in the form of a film covering the substrate surface, or changes in the chemical composition of the substrate to provide the substrate with a more metallic appearance.

The present invention provides a novel method for forming Ti-based coatings on large area substrate based on reacting the substrate surface with an uncoated powder or nanopowder comprising Ti and/or titanium subchlorides or other solid titanium halides. The method involves reduction of titanium subchlorides with a reducing agent preferably based on Na, K and/or Al, leading to a product of a coated substrate and a by-product that can include titanium tetrachloride, potassium chloride, sodium chloride or aluminium chloride; hereinafter the terms aluminium chloride(s) and $AlCl_3$ are used to describe all Al—Cl species. Also, gaseous $H_2$ may be used as a reducing agent.

In one preferred embodiment, there is provided a method for coating large area substrates, wherein a powdered substrate is immersed in a powder comprising titanium subchlorides and a reduced agent based on Na, K, and Al, and heated at temperatures below 850° C. to metallise the surface either through incorporating Ti in its chemical composition and/or through forming a metallic Ti based coating on its surface.

The substrate can be conducting or a dielectric, and preferably, is in the form of a powder or flakes or a multitude of small objects, and a product of said method is a substrate coated with a Ti-base metal or alloy. In some preferred embodiments, the substrate is made of a material with a low reactivity such as oxides, nitrides or other stable compounds (e.g. glass, quartz . . . ). Examples of suitable substrates include glass flakes, glass beads, glass powder, mica flakes, dielectric flakes, carbon fibre, beads and powder, and steel balls, and fastening accessories and screws and washers. In other embodiments, the substrate is made of a powdery conducting material such as pure metal, an alloy, a composite which may be in powdery, flaky, or fibrous forms.

In one preferred embodiment, the method comprises the steps of:

- producing in-situ an uncoated powder including metallic species based on Ti, and Ti—Cl and the coating additives, wherein the average weight ratio of Cl to Ti in all species based on Ti and Ti—Cl is less than 59:41; and
- reacting the said powder with the surface of the substrate to produce a coating; preferably, the uncoated powder is an uncoated nanopowder, where a fraction of the powder has a particle size less than 1 micron and preferably less than 100 nm.

For most of the foregoing and forthcoming embodiments, forming coating on the substrate surface requires heating the substrate with the said uncoated powder/nanopowder at temperatures between 400° C. and 850° C. This processing step is referred to as the Coating Stage.

In one preferred embodiment, the method comprises the steps of:

- in a first step, solid precursor materials including one or more titanium subchloride and a reducing agent are mixed with or without a substrate and heated at temperatures between $T_1$ and $T_2$ for times long enough to reduce the titanium chlorides to a composition Ti—$TiCl_x$ with an average chlorine content less than $TiCl_2$ (weight ratio of Cl to Ti equivalent to less than 59:41); $T_1$ is higher than 160° C. and preferably higher than 200° C., and a $T_2$ is below 500° C.
- in a second step (Coating Stage), the reactants from the first step are mixed together with the substrate are heated at temperatures between $T_3$ and $T_{max}$; $T_3$ is between 200° C. and 500° C. and $T_{max}$ is between 400° C. and 850° C., and $T_{max}$ is preferably below the melting/decomposition temperature of the substrate materials.

Processing according to this embodiment can be in a continuous mode or in a batch mode.

Preferably, processing in the Coating Stage is accompanied by vigorous mixing to maximise contact between the various components of the mixture and optimise coating of the substrate surface. A second role for the mixing process is to bring elemental products produced as a result of reactions between the precursor materials and the reducing agent into contact with the substrate rapidly after they are formed and before they agglomerate or sinter into large particles. Nanoparticles and sub-nanometre clusters tend to adhere to the substrate surface significantly faster than large particles.

The processing temperatures depend on both the substrate materials and the reducing agent. For embodiments using Al as a reducing agent, it is preferable that the minimum temperature during processing be approximately 200° C. so that it is higher than the sublimation temperature of aluminium chloride. For embodiments using Na or K as reducing agents, the minimum temperature can be 25° C., and the by-products include NaCl or KCl, and then there is the additional step of separating the coated substrate from the by-product. Preferably, this separation step is done by washing.

The maximum temperature in the Coating Stage is determined by factors including the kinetic barrier of reactions between the precursor materials and the reducing Al agent and the adhesion of the coating to the substrate; preferably, this maximum is below the melting temperature of the substrate. However, the maximum temperature can exceed the melting temperature of the substrate if the deposited materials are required to penetrate through or react with the bulk of the substrate. In all cases, the present invention is intended for operation at a maximum temperature not exceeding 850° C. and preferably not exceeding 800° C. By way of illustration only, if the substrate is made of borosilicate glass beads or borosilicate glass flakes, then coating on the substrate can be achieved at a temperature of 650° C. at 1 atm, decreasing to less than 500° C. if the process is carried out at 0.1 atm but with appropriate reactant composition. For coatings on a mica substrate, the required maximum temperature is around 700-750° C. For coating on graphite, the temperature can be up to 850° C.

In all embodiments, the reducing agent is preferably in a fine particulate form and is different from the substrate powder. For such embodiments, Al is a preferred reducing agent, and Al is introduced for processing with the other reactants in the form of a powder of pure Al or an Al alloy. Al is most suitable as a reducing agent because its chlorides $AlCl_3$ have a low sublimation temperature and can be continuously separated from the coated substrate.

In preferred embodiments, the titanium subchlorides are in the form of a fine powder with a grain size less than 500 microns and preferably less than 100 microns.

In one preferred embodiment, the method includes the primary step of producing titanium subchlorides by reducing $TiCl_4$ to $TiCl_3$ according to prior art methods such as those disclosed in U.S. Pat. Nos. 4,079,175, 3,998,911, 3,530,107, 3,451,768, 3,172,865, and references therein. Methods for reducing $TiCl_4$ to solid subchlorides are well established and have been used extensively on a commercial scale since 1960 for production of Ziegler-Natta polymerisation catalysts (Handbook of industrial Catalysts, Lawrie Lloyd, Springer-Verlag, N.Y. 2013). In a second step, the solid powder resulting from the primary step is reacted with the substrate surface in the Coating Stage according to any of the embodiments to form a coating.

In some embodiments, when the substrate is reactive and can react with the reducible titanium chlorides, the amount of reducing agent powder can be reduced substantially even down to zero as the substrate can then act as a reducing agent. For example, for a mica substrate with a typical composition of $KAl_3Si_3O_{10}(OH)_2$, titanium subchlorides react with the mica leading to formation of KCl together with the incorporation of metallic Ti into the substrate surface. Moreover, in some embodiments, reactions between the chlorides and the substrates can change the chemical composition of the substrate, making it more metallic, without incorporating substantial amounts of Ti into the substrate. Coating of the substrate surface according to mechanisms due to direct chemical reactions between the reducible titanium chlorides and the substrate is included in the present disclosure.

In one variation of this last embodiment, reactive substrates may be used in a primary stage to reduce $TiCl_4$ to titanium subchlorides. In one form of this variation, the primary stage and the subsequent processing and Coating Stage are carried continuously and as parts of a single heating cycle. Here, metallisation of the substrate and/or formation of a coating on the substrate may occur due to direct reactions between $TiCl_4$ the and the substrate.

In any of the embodiments of the method, the substrate can be a powder of glass, glass flakes, glass beads, mica flakes, talc powder, carbon fibre, carbon beads or other conducting or dielectric materials and the precursor materials includes additive precursors based on any number of other non-inert elements from the periodic table. The substrate cannot be a halide-based material and the substrate materials cannot be a metallic Ti alloy powder.

The weight ratio of solid titanium subchlorides to substrate can be between 0.01 to 1 and 5 to 1 depending on the substrate volume and particle size. Preferably, the ratio is between 0.05/1 and 2/1 and more preferably between 0.1/1 and 1/1.

In one example for coating glass flakes with titanium, the ratio of solid titanium subchlorides to substrate can be between 0.01 and 0.2.

In one example for coating an Fe powder with an average grain size of 50 microns, the ratio of solid titanium subchlorides to substrate can be between 0.5 and 2.

In one example for coating glass beads, the ratio of solid titanium subchlorides to substrate can be between 0.01 and 1.

In one example for coating graphite powder, the ratio of solid titanium subchlorides to substrate can be between 2 and 1.

The coating can include any number of coating additives based on any non-inert chemical elements. Coating additives can be introduced through precursor chemicals containing the required elements can be in a solid form or a gaseous form, and can be introduced at any stage during processing before the Coating Stage.

In one embodiment, wherein reactive coating additives capable of reacting with Ti to form a Ti compound are used, the product can be a powder coated with titanium compounds based on the additives. E.g. for additives comprising carbon, silicon, oxygen and nitrogen, the coating can include Ti carbides, Ti silicides, Ti oxides and Ti nitrides respectively.

In one embodiment, the method comprises reacting a part or all of the substrate with the coating to produce a product of intermetallics, alloys or compounds based on the substrate materials and the coating materials. For example, when the precursor materials are titanium chlorides and the substrate is a powder of graphite, then the product of said method can be a graphite powder coated with titanium carbide.

In one embodiment, the substrate materials include silicon based chemicals and the coating includes titanium silicides.

In one embodiment, the substrate is a powder of glass flakes and the coating includes titanium silicides. In one form of this embodiment, the substrate is a powder of borosilicate and the coating is based on Ti in addition to the constituting elements of the flakes including Si and B.

In one embodiment, the coating reacts with the substrate to form composite materials or compounds based on the substrate and the coating.

In one embodiment the coating reacts partially with the substrate to form a coating based on the substrate and the coating.

The amount of reducing agent used depends on the starting precursor materials and the required composition of the end products and can be below the stoichiometric amount needed to reduce all the reducible starting precursor chemicals. Preferably, the amount of reducing agent is between 50% and 200% of the amount required to reduce a starting reducible precursor chemicals of $TiCl_3$ to Ti. However, in some preferred embodiments wherein the substrate is reactive or its composition includes elements such as Na, K or Al, the amount of reducing agent can be below 50% and down to 0.01% of the amount required to reduce a starting $TICl_3$ to $M_c$.

In one preferred embodiment, the method comprises diluting the solid reactants with $AlCl_3$ before mixing with the substrate. In another form of this embodiment, the reducing agent and/or the reducible chemicals can be separately mixed with $AlCl_3$. The diluting step is intended to increase the dilution of the reactants and improve coverage of the substrate. The amount of $AlCl_3$ can be between 10% and 500% of the weight of the substrate. In one preferred embodiment, the volume of the $AlCl_3$ is equivalent to the volume of the substrate. Mixing the reducible chemicals with $AlCl_3$ may be done by any prior art mean, including co-milling.

Preferably, for all embodiments, the process is carried out in an inert gas, preferably Ar or He.

In one embodiment, the gas stream consists of a mixture of Ar and reactive gases such as $O_2$ and nitrogen.

In one embodiment, the method comprises an additional step wherein materials obtained at the end of the coating process can be further reacted with gaseous reactants at temperatures between 25 C and 850° C. Gaseous reactants include gases containing reactive elements such as oxygen, nitrogen, boron and carbon. Reactive gaseous reactants may be introduced at any time or any stage during processing, but preferably during the Coating Stage. For example, in one embodiment, a reactive gas of $O_2$ is introduced immediately after the sample has been processed in the Coating Stage at a temperature $T_{max}$ to oxidise the Ti-based film already formed on the substrate surface. In another embodiment, a Ti-coated substrate is heated separately in a post processing step in a stream of oxygen to produce a Ti-based oxide. Alternatively, coating of titanium oxides on a substrate can be achieved by carrying out the reaction in a stream of argon containing a controlled amount of oxygen.

In one preferred embodiment, a stream of inert gas is arranged to flow in a direction away from the reactants and the solid reaction products.

In any of the embodiments, the method may comprise the step of separating the coated substrate from any residual un-reacted precursor materials and un-reacted aluminium. The method can also include the step of washing and drying the end products.

In any of the embodiments, the coated substrate may include by-products or residual by-products, and the method may comprise the step of separating the by-products from the coated substrate. This separation step can be carried out during processing or in post processing after the coated substrate has been collected.

In any of the embodiments, the method can be carried out at pressures between 0.01 mbar and 1.1 bar.

In all forms and embodiments of the method, the coating and the product of said method can include residual reducing agent metals.

In a most preferred embodiment, the starting titanium subchloride is $TiCl_3$.

In one embodiment where the reducing agent is based on Al, the method comprises the steps of:

- preparing a first stream of reducible precursors comprising titanium subchlorides; and
- preparing a second stream comprising the reducing Al; and
- mixing the said streams with $AlCl_3$ as necessary to increase their volume; and
- mixing the said streams with a substrate powder; and
- stirring, heating and reacting the resulting mixture comprising the said titanium subchlorides and Al together with a large area substrate at a pressure between 0.01 mbar and 1.1 bar and at temperature between 160° C. and a maximum temperature $T_{max}$ to produce a Ti-based coating on the large area substrate; $T_{max}$ is preferably below 850° C. and more preferably below 800° C. and still more preferably below 700° C.; and
- the amount of reducing Al alloy used is preferably higher than the amount needed to reduce all the starting titanium subchlorides to an average composition equivalent to less $TiCl_2$; and
- the reaction by-products of aluminium chloride and titanium tetrachloride are removed away from the coated substrate; and
- collecting the resulting products, and as necessary separating the coated substrate from residual un-reacted materials and washing and drying the coated substrate.

In one variation of last embodiment, the large area substrate is introduced after the titanium subchlorides have been reacted with the Al and just before processing though the Coating Stage.

The method of the present invention differs from prior arts in many aspects. For the following discussion, we will be using the example of Al to illustrate physical and chemical aspects of the method.

The brief discussion presented below is only meant to highlight basic processes believed to be occurring within the reacting system (e.g. Ti—Al—Cl— substrate system) and is not intended as a comprehensive analysis. It is not intended that the present invention be limited to any theory or mechanism of action.

For the present approach, the coating of the substrate in the Coating Stage results from a combination of effects comprising:

- i—heterogeneous reactions taking place at the surface of the substrate and leading to direct deposition of elemental products on the substrate surface,
- ii—chemical and physical interactions between the substrate surface and uncoated powders/nanopowders produced at temperatures below 500° C. before the Coating Stage,
- iii—formation of metallic particles/nanoparticles and clusters followed by adhesion to the surface,
- iv—disproportionation of unsaturated intermediate compounds on the surface of the substrate, and
- v—reactions between the substrate surface and precursor materials.

Reactions between titanium subchlorides and the reducing metals are heterogeneous, meaning that they take place on solid surfaces where elemental condensed titanium Ti(c) can condense. Available surface for condensation of Ti(c) is primarily the substrate surface, and as such the substrate plays a key role as a catalyst in helping generate the Ti-based powder/nanopowder and metallic species and forming the coating. Ti(c) species generated on the substrate surface do not necessarily adhere to the surface as adhesion requires a minimum threshold temperature and/or operation at low pressures. For example, for a substrate of glass flakes, processing at 450° C. under 1 atm does not produce satisfactory coating, while processing at 600° C. results in metallic Ti coating. Reactions occurring immediately adjacent to the substrate above the threshold adhesion temperature can lead to the Ti(c) products directly deposited on the surface. In a preferred embodiment, process conditions are arranged to maximise reactions between $TiCl_x$ and Al taking place at the substrate surface through efficient mixing of the reactants at temperatures between 200° C. and 600° C.

When the reduction reactions are not taking place on the substrate surface, small nanometre (or sub-manometer) clusters and agglomerates based on Ti and Ti—Al can form and efficient mixing is required to bring the agglomerates into contact with the substrate before they form large particle and either become lost to the process or deteriorates the quality of the coating.

Adsorption (both chemical and physical) of elemental Ti can occur on the surface of the subchlorides particles leading to non-stoichiometric subchloride macro-particles and contact of the macroparticles with a stable surface such as the substrate or other metallic Ti particulate surfaces can lead to discharging of the elemental Ti onto the stable surface.

Direct reactive interactions between Ti-based phases and the substrate can contribute significantly to the coating process; as titanium is a highly reactive element, the substrate surface can react with solid Ti reactants and the resulting coating can comprise compounds based on the substrate materials and the coating materials. A key aspect of the present method is the enhanced ability of the Ti-based nanoparticles to react with the substrate leading to formation of coatings based on Ti and the substrate materials. As discussed before, the small particle size of the powder with the associated high surface energy together with the absence of oxides on the substrate surface help reduce the kinetic barrier for reactions between titanium and the substrate surface, allowing for formation of chemicals bonds between Ti and the substrate materials at low(er) temperatures.

Also, there are the important effects of chlorides which are known to enhance transport of metal species along the substrate surface and help breakdown stable compounds that may exist on the substrate surface.

Another important mechanism contributing to the coating is due to formation of highly unsaturated compounds (i.e. $TiCl_2$) followed by disproportionation. The inventor has found that this particular disproportionation mechanism gains significant efficiency when the reaction is carried out at low pressures (for example below 0.7 bar).

Coating due to interactions between the powder and the substrate is likely to dominate at atmospheric pressure while disproportionation gains importance at low pressures. For example, when the substrate is made of silicon based materials and the process is carried out at 600° C. in inert gas a 1 atm, Ti can react with Si from the glass substrate to form a coating comprising titanium silicides. In contrast, when processing is carried out at low pressure at 450° C., the coating is mostly of pure Ti and the second mechanism tends to prevail.

For the disproportionation of species $TiCl_2$ and $TiCl_3$, which are usually important in coating applications, $$TiCl_3+TiCl_3 \longleftrightarrow TiCl_2+TiCl_4 \quad \Delta G>50 \text{ kJ/mole at } T<1000° \text{ C.} \tag{R1}$$

$$TiCl_2+TiCl_2 \longleftrightarrow Ti(c)+TiCl_4 \quad \Delta G>50 \text{ kJ/mole at } T<1000° \text{ C.} \tag{R2}$$

the inventor has found that both endothermic reactions R1 and R2 are unfavourable for producing Ti(c) below 1000° C. and 1 atm. R1 leads to formation of $TiCl_2$ and it does not play a direct role in the coating process. For R2, the efficiency of $TiCl_2$ disproportionation depends on the relative composition of the reactants and R2 can dominate under conditions involving low pressure operations and/or forced reduction of the partial pressure of $TiCl_4$. For R2, Ti is directly deposited on the surface of the substrate when the reaction is taking place on the surface.

It is to be noted that under all conditions, but in particular when disproportionation reactions are enhanced at low pressure, the end product might contain significant residual Al impurities. Also, for embodiments based on low pressures, for example less than 0.7 atm, it is intended that reference to reaction between the substrate surface and powder includes disproportionation reactions occurring on the substrate surface and leading to direct coating of the surface.

For reactions involving titanium subchlorides and the substrate, as subchlorides are highly reactive substances and when the substrate is reactive or partially reactive, various reactions such as replacement reactions or oxidation reactions can occur, leading to coating or metallisation of the substrate. For example, when the substrate composition includes elements such as Na, K, and Al, then the substrate can play a reducing role, leading to either coating the surface or to incorporation of coating metals into the chemical structure of the substrate, or to altering the substrate chemical composition to a more metallic structure.

Yet further forms of the invention relate to coated particulate substrates formed by the described methods.

Further example forms of the invention will be apparent from the figures, description and examples below, and from the claims.

BRIEF DESCRIPTION OF THE DRAWINGS

Features and advantages of the present invention will become apparent from the following description of embodiments thereof, by way of example only, with reference to the accompanying drawings, in which.

DESCRIPTION OF PREFERRED EMBODIMENTS

Figure 1:
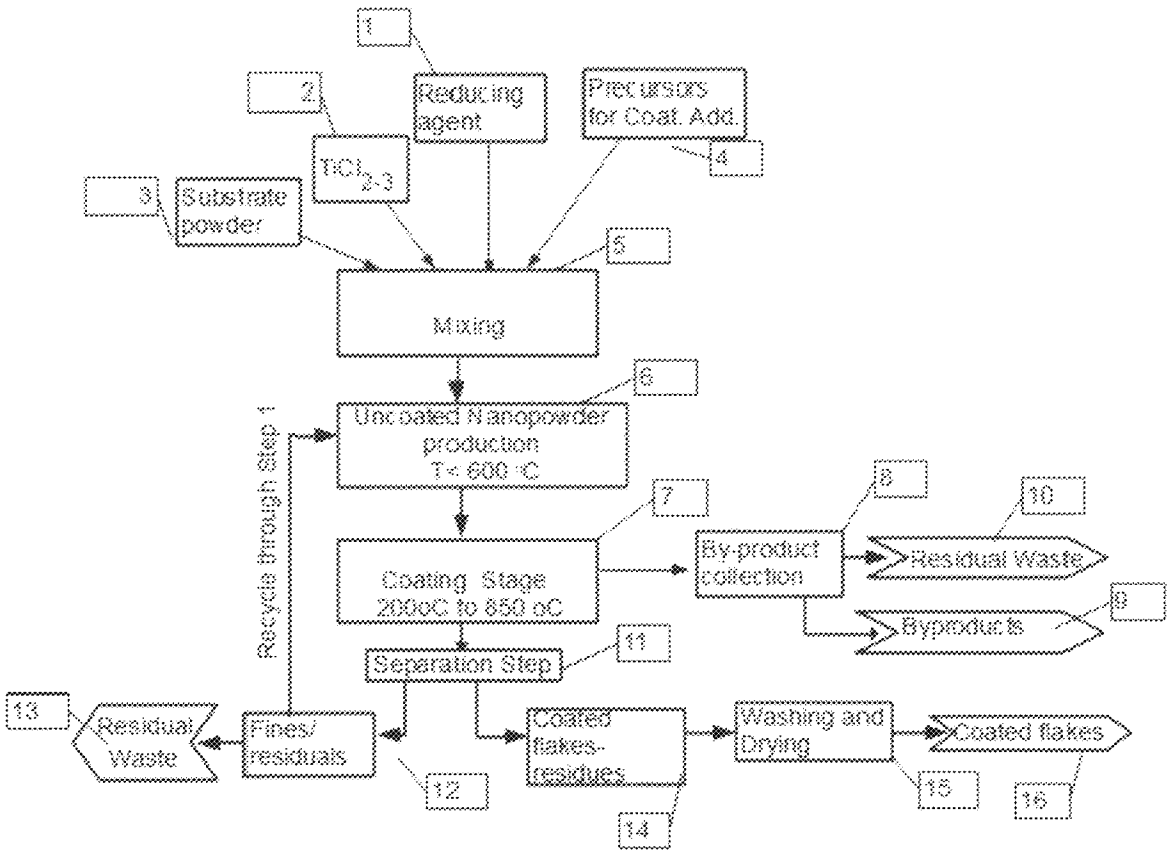
FIG. 1: A block diagram for one embodiment illustrating general processing steps for forming Ti-based coating on a substrate surface.

FIG. 1 is schematic diagram illustrating general processing steps for depositing a Ti coating on a powdery substrate. In a first step, the reducing agent $R_a$ (1), is mixed together with the titanium subchlorides (2), the substrate (3) and the additive precursors (4) in (5). The resulting mixture is then processed in (6) at temperature below 600° C. to produce an intermediate product comprising an uncoated powder and $TiCl_x$, which is then progressed through the Coating Stage (7) to form a coating on the substrate surface. By-products (8) are discharged in (9) and the residual waste is processed through (10).

In step (11), the products from (7) are sieved to remove any residual fines (12) which can be either recycled through (6) or withdrawn (13). Sieved coated products (14) can then washed and dried in necessary (15) leading to final product (16)

Figure 2:
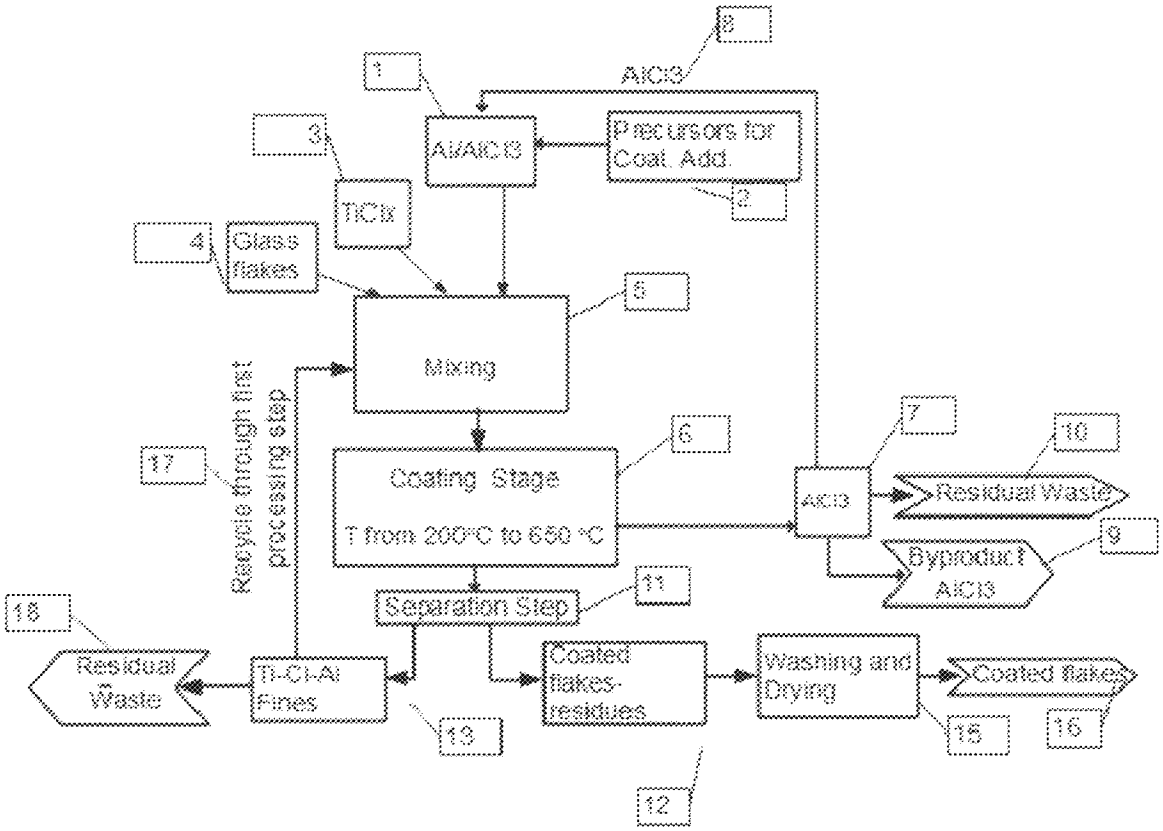
FIG. 2: A block diagram for one embodiment illustrating steps for forming of titanium based alloys on a substrate, starting from $TiCl_3$ and Al.

FIG. 2 is a schematic diagram illustrating processing steps for one preferred embodiment for production of Ti coated glass flakes using Al as a reducing agent. Al and $A/Cl_3$ are first mixed together at (1) to dilute the Al and spread its distribution within the reactant-substrate mixture. Precursors for coating additives ($M_z$) (2) may also be added and mixed together with the Al—$AlCl_3$ depending on their compatibility with Al and $AlCl_3$. The Al—$AlCl_3$-$M_z$ powder is then mixed with $TiCl_x$ (3) and the substrate powder (4) in step (5); for this embodiment, $TiCl_3$ is the starting subchloride, glass flakes are used as substrate and the mixing can be before or during processing in step (5). The resulting $TiCl_3$—Al—$AlCl_3$-glass flakes mixture (5) is then processed at temperatures between 200° C. and 650° C. in a single cycle combining the uncoated powder production step and the Coating Stage (6). $AlCl_3$ by-products are removed in a stream of inert gas away from the reaction zone and condensed elsewhere (7). A part of the $AlCl_3$ might be recycled through (8) as shown in the diagram. The rest (9) are discharged and stored for disposal or other use.

The remaining inert gas with any residues (10) is processed through a dedicated scrubber. At the end of the reaction, there is a separation step (11) where coated flakes (12) are separated from the Ti—Cl—Al based fines (13) and then washed and dried in dedicated equipment (15) and the resulting end product (16) is discharged and ready for use.

The Ti—Cl—Al based fines (13) can be recycled (17) or discharged (18).

Materials produced using the present invention have unique characteristics that may not be obtained using prior art methods. The invention includes materials made using the present coating invention and the use of such materials, without being limited by the examples provided in the specifications by way of illustration. Specific properties include the ability to produce coating for large area substrate of composition and structure usually unachievable with conventional physical vapour deposition or chemical vapour deposition.

As an example for the specific quality and use of materials produced using the current technology is in production of metallic Ti-based pigment for use in the paint industry. Currently, there are no technologies capable of producing titanium metal based flakes at an affordable price. Such pigments would be very attractive for use in the automotive paint industry and in the architecture and paint industry in general. It is also possible to change the hue, the reflectance and the refraction of the coating by changing the composition. For example, adding chromium to titanium results in increased reflectance while adding other materials such vanadium provides a dull metallic colour to the film. It is also possible to change the colour and the interference characteristics of the pigment by addition of a varying amount of oxygen to the Ti film covering the substrate.

The following are examples of preparation of titanium compounds in accordance with an embodiment of the present invention.

EXAMPLE 1

Ti on Glass Flakes

Figure 3:
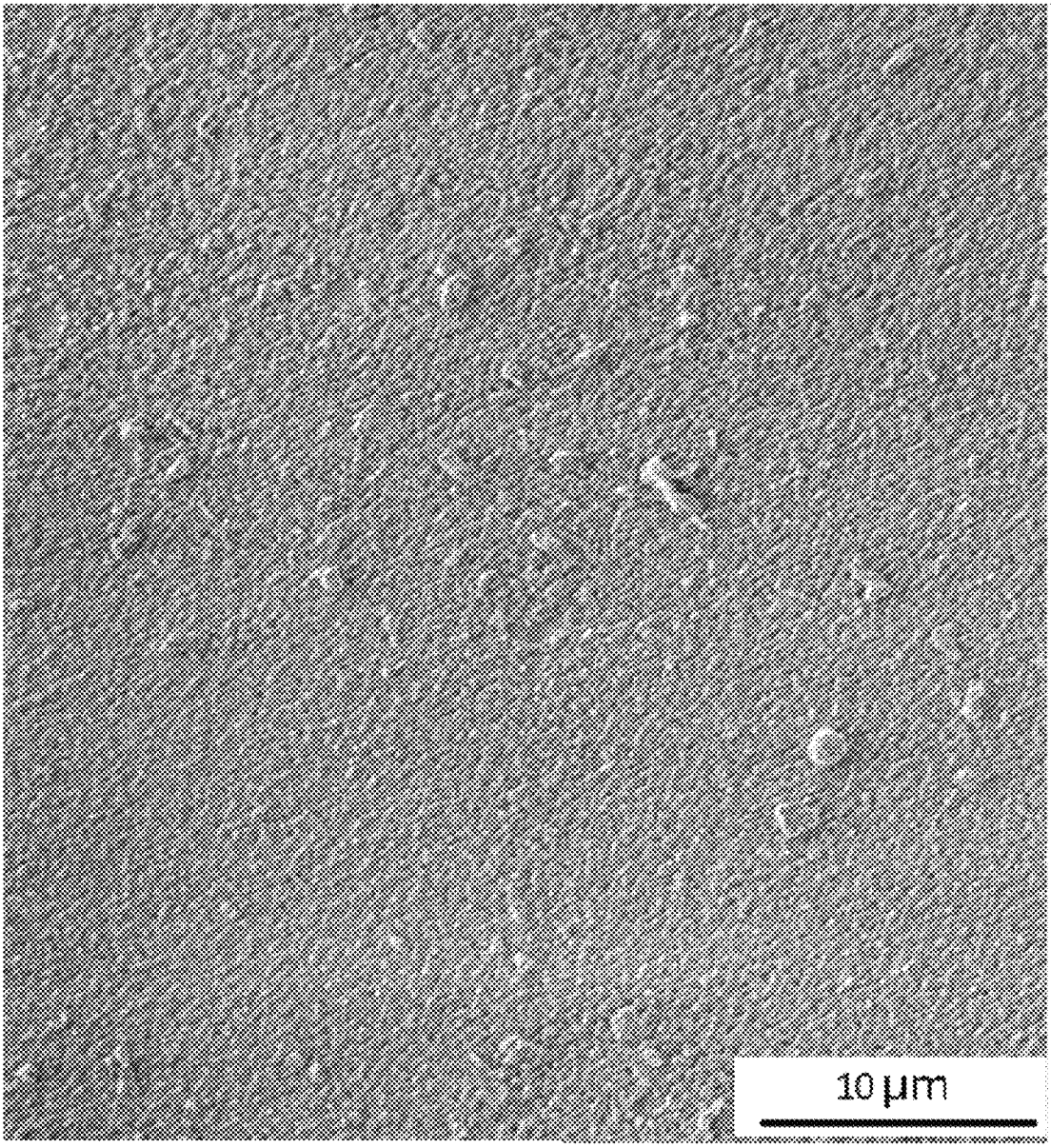
FIG. 3: An SEM micrograph showing Ti-based coating on glass flakes.
Figure 4:
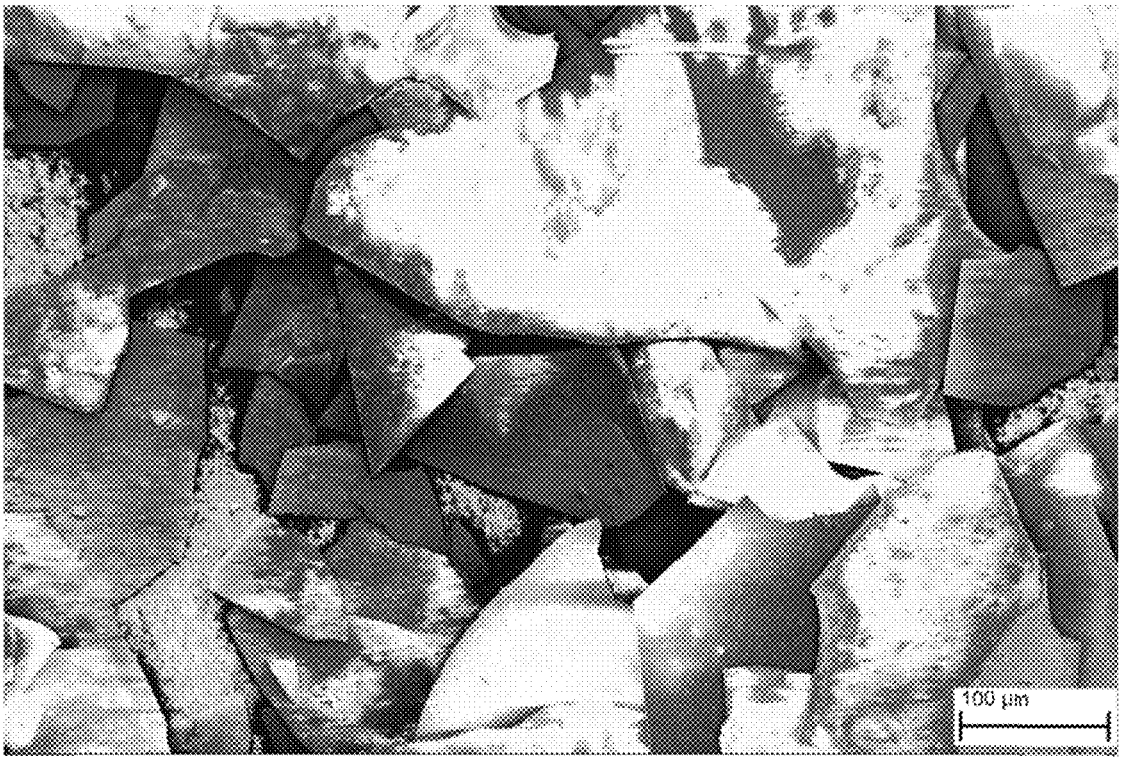
FIG. 4: An SEM micrograph showing glass flakes coated with Ti.

The starting materials were 1 g of $TiCl_3$ powder 170 mg of Ecka Al powder (4 microns) and 4 g of $AlCl_3$ powder. The starting materials were mixed together and the resulting mixture was thoroughly mixed with 10 g of glass flakes. The resulting mixture was heated in a rotating quartz tube under argon at a temperature of 575° C. for 10 minutes. The powder was then sieved to remove un-deposited products and the remaining coated flakes washed in water and dried. The flakes have a darkish metallic titanium appearance. Examination under an SEM shows that the surface is thoroughly coated with metallic Ti but with the presence of metallic titanium particulates. SEM micrographs for coated flakes are in FIG. 3 and FIG. 4.

EXAMPLE 2

Ti on Mica Flakes

The starting materials were 1 g of $TiCl_3$, and 4 g of $AlCl_3$. The starting materials were mixed together and the resulting mixture was thoroughly mixed with 10 g of mica flakes. The resulting mixture was heated in a rotating quartz tube under argon at a temperature of 575° C. for 10 minutes. The powder was then sieved to remove un-deposited products and the remaining coated flakes washed in water and dried. The flakes have shiny metallic appearance.

EXAMPLE 3

Ti on Carbon Fibres

The starting materials were 1 g of $TiCl_3$ powder, 170 mg of Ecka Al powder (4 microns) and 4 g of $AlCl_3$ powder. The starting materials were mixed together and the resulting mixture was thoroughly mixed with 1 g of carbon fibres (cut to ~1 cm length). The resulting mixture was heated in a rotating quartz tube under argon at a temperature of 750° C. for 10 minutes. The products were then sieved to remove un-deposited/unreacted materials and the remaining coated fibres washed in water and dried. SEM analysis shows the fibre are coated with a Ti-based coating. The fibres have very high resistance to oxidation and after burning a sample in air for 48 hours at 800° C., the residue are empty long tubular shells of titanium oxides.

The present method may be used for production of coating or compounds of various compositions based on Ti including coatings of pure metal, alloys, oxides, nitrides, with additives including other coating additives as described above. Modifications, variations, products and use of said products as would be apparent to a skilled addressee are deemed to be within the scope of the present invention.

In the claims which follow and in the preceding description of embodiments, except where the context requires otherwise due to express language or necessary implication, the word "comprise" and variations such as "comprises" or "comprising" are used in an inclusive sense, to specify the presence of the stated features but not to preclude the presence or addition of further features in various embodiments of the invention.

It will be understood to persons skilled in the art of the invention that many modifications may be made without departing from the spirit and scope of the invention, in particular it will be apparent that certain features of embodiments of the invention can be employed to form further embodiments.

The invention claimed is:

1. A method for forming Ti-based coatings on a particulate substrate, including:

a) forming an uncoated Ti-based powder by reacting at least one solid titanium subchloride with a solid Al reducing agent, wherein the Al reducing agent is an Al powder or an Al alloy powder;

b) mixing the particulate substrate with the uncoated Ti-based powder; and c) heating the particulate substrate in contact with said uncoated Ti-based powder to a temperature less than 850° C. to produce a coating on said particulate substrate.

2. The method according to claim 1, wherein in a first step, the titanium subchloride reacts with the reducing agent to produce said uncoated powder, the uncoated powder is substantially free of oxygen and has a grain size less than 1 micron.

3. The method according to claim 1, comprising the steps of:

mixing, stirring and heating a mixture of the at least one solid titanium subchloride, the Al reducing agent and the particulate substrate at temperatures between a first temperature $T_0$ above 160° C. and a maximum temperature $T_{max}$ below 850° C. to form the coating on the substrate and by-products including aluminium chloride and titanium tetrachloride; to reduce titanium subchlorides to a composition with a chlorine content less than $TiCl_2$; and the Ti-based coating comprises one or more of pure element, an alloy, an intermetallic compound, an inorganic compound, oxides, nitrides, carbides, borides or silicides; and condensing the by-products away from a reaction zone where the aluminium and precursor material are reacting; and collecting the resulting products, and separating the coated substrate from residual un-reacted materials and washing and drying coated substrate.

4. The method according to claim 1, wherein the uncoated Ti-based powder is a Ti-based nanopowder.

5. The method according to claim 4, further including a primary step of reducing $TiCl_4$ to form the titanium subchlorides.

6. The method as claimed in claim 1, wherein the process is continuous and a stream of gas is passed in a direction away from solid reactants, and by-products are continuously removed away from the reactants.

7. The method as claimed in claim 1, wherein the method is carried out at a pressure between 0.01 mbar and 1.1 bar; and wherein the particulate substrate is in the form of a powder, flakes, beads, fibres, particles or a number of small objects.

8. The method according to claim 1, wherein the weight ratio of solid titanium subchlorides to substrate is between 0.01 to 1 and 5 to 1.

9. The method according to claim 1, wherein the Ti-based powder and an Al reducing agent starting materials are mixed with $AlCl_3$ before mixing with the substrate, and wherein the weight of $AlCl_3$ is between 10% and 500% of the weight of the Ti-based powder and the Al reducing agent.

10. The method according to claim 1, wherein the method includes an additional step of reacting the coated substrates with a reactive gas.

11. The method according to claim 1, wherein a mixture including $TiCl_x$—$R_a$ is heated at temperature up to 500° C. in step (a) to produce a mixture including metallic Ti-based species and then the resulting reactant mixture is mixed with the substrate in step (b), wherein TiCl is the titanium subchloride, and $R_a$ is the Al reducing agent.

12. The powder method according to claim 1, comprising:

in a first step, a mixture comprising the titanium subchlorides, the Al powder, and optionally the particulate substrate in powder form, are heated at temperatures between $T_0$ above 160° C. and $T_1$ below 500° C. to form a mixture comprising metallic Ti—Al species in a fine powder or in a nanopowder form containing a component with a particle size below 1 micron; and adding the substrate powder if not added in the first step and mixing; and heating the resulting mixture comprising the metallic Ti-based species and the particulate substrate at temperatures between $T_2$ above 160° C. and $T_{max}$ below 850° C. to induce reactions between the Ti—Al species and the substrate and cause a coating to form on the surface of the substrate.

13. The method according to claim 1, wherein the substrate is selected from the group consisting of i—transition metal alloys, oxides, nitrides, carbides, or borides, ii—glass, glass flakes, glass beads, quartz, borosilicate, soda-glass, silicon nitride, mica flakes, talc powder, iii—graphite powder, graphite flakes, carbon fibre and a combination thereof of i—, ii—, and iii—;

wherein the substrate is in the form of a powder, flakes, beads or fibres.

14. The method according to claim 13, wherein the substrate materials include silicon.

15. The method according to claim 14, wherein the substrate is a powder of glass flakes and the coating includes titanium silicides.

16. The method according to claim 14, wherein the substrate is made of borosilicate and heating of the particulate substrate is to a maximum temperature $T_{max}$ below 650° C., or the substrate comprises soda-glass and heating of the particulate substrate is to a maximum temperature $T_{max}$ below 600° C.

17. The method according to claim 13, wherein the substrate is based on carbon and comprises powder, beads, flakes or fibre and the coating includes titanium carbides.

18. The method according to claim 13, wherein the substrate comprises at least one transition metal in the form of powder, beads, flakes or fibre and the Ti-based coating includes titanium-transition metal compounds.

19. A method for forming Ti-based coatings on a particulate substrate, including:

mixing, stirring and heating a mixture comprising at least one titanium subchloride, a solid Al reducing agent, a coating additive and a particulate substrate in the form of a powder, at temperatures between a first temperature $T_0$ above 160° C. and a maximum temperature $T_{max}$ below 850° C. to form the Ti-based coating on the substrate and by-products including aluminium chloride and titanium tetrachloride;

wherein the Al reducing agent is in a fine particulate form and an amount of Al is sufficient to reduce the at least one titanium subchloride to a composition with a chlorine content less than $TiCl_2$; the coating additive includes sources for at least one of C, Si, B, $O_2$ and $N_2$, and the coating is based on titanium in the form of at least one of a titanium carbide, silicide, boride, oxide or nitride, and condensing the by-products away from a reaction zone where the Al reducing agent and the at least one titanium subchloride are reacting; and collecting reaction products, and separating the coated substrate from residual un-reacted materials, and washing and drying the coated substrate.

* * * * *